US006229424B1

(12) United States Patent
Tajima et al.

(10) Patent No.: US 6,229,424 B1
(45) Date of Patent: May 8, 2001

(54) VARIABLE LINEARITY COIL

(75) Inventors: Takashi Tajima; Takeshi Ikeda; Masaharu Takebuchi, all of Gunma-ken (JP)

(73) Assignee: Taiyo Yuden Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/193,726

(22) Filed: Nov. 17, 1998

(30) Foreign Application Priority Data

Nov. 28, 1997 (JP) ..... 9-327951

(51) Int. Cl.[7] ..... H01F 21/00
(52) U.S. Cl. ..... 336/110; 336/96
(58) Field of Search ..... 336/110, 185, 336/96, 200, 155; 335/210–213; 315/400

(56) References Cited

U.S. PATENT DOCUMENTS 3,100,882 * 8/1963 Burnell ..... 336/96
3,701,067 * 10/1972 Tsubakihara ..... 336/90
4,675,615 * 6/1987 Bramanti ..... 330/8
4,713,589 * 12/1987 Kashiwagi ..... 315/400
4,878,412 * 11/1989 Resnick ..... 84/726
5,034,854 * 7/1991 Matsumura et al. ..... 336/92
5,103,201 * 4/1992 Schmeller ..... 336/178
5,473,299 * 12/1995 Tsutsumi et al. ..... 336/110

FOREIGN PATENT DOCUMENTS 58-97807 * 10/1983 (JP) ..... H01F/2/08

* cited by examiner

*Primary Examiner*—Lincoln Donovan
*Assistant Examiner*—Tuyan T. Nguyen
(74) *Attorney, Agent, or Firm*—Arent Fox Kintner Plotkin & Kahn, PLLC

(57) ABSTRACT

A variable linearity coil has a coil which is wound around a magnetic core, a permanent magnet for charging a bias magnetic field to the magnetic core, and a magnetic field adjusting coil for adjusting the bias magnetic field. The coil and the magnetic field adjusting coil are respectively disposed horizontally such that an axial line of each of the coils lies perpendicular to lead terminals to which terminal ends of each of the coils are connected. The coil, the magnetic field adjusting coil, and the permanent magnet may be contained in a casing and the terminal ends of each of the coil and the magnetic field adjusting coil are connected to lead terminals which are embedded into the casing.

14 Claims, 4 Drawing Sheets

VARIABLE LINEARITY COIL

BACKGROUND OF THE INVENTION

1. Field of the Invention

The present invention relates to a variable linearity coil which is used in a monitor of a personal computer, or the like.

2. Description of the Related Art

As is well known, the linearity coil is interposed for connection to a horizontal deflection circuit of a monitor of a television receiver set, personal computer, or the like for the purpose of correcting distortions on a monitor screen. In the television receiver set, or the like, the frequency of the electric current to flow or to be charged in the linearity coil is constant at 15.75 kHz or 33.75 kHz. Therefore, the correction of the distortions was possible with a linearity coil of a constant or predetermined DC (direct current) magnetic field. In the monitor of the personal computer, on the other hand, the range of the frequency of the electric current to be charged is as wide as 15 kHZ to 120 kHz. Therefore, there occurs a difference in the amount of correction between the time when the frequency is low and the time when the frequency is high. It follows that an appropriate correction of distortions cannot be made in a predetermined DC magnetic field.

As a solution, there has conventionally been proposed the following variable linearity coil as shown in FIG. 7. Namely, a magnetic core b which is made by winding therearound a coil "a" and a magnetic core d which is made by winding therearound a magnetic field adjusting coil c for adjusting the bias magnetic field are placed one on top of the other in a vertical posture (i.e., with an axis of winding the coil extending in the up and down direction) together with permanent magnets $e_1$, $e_2$. The assembly thus obtained is placed on top of a base g which has embedded therein lead terminals f. The lead terminals f are connected to respective terminal ends of the coil "a" and the magnetic field adjusting coil c.

In the above-described conventional variable linearity coil, the magnetic cores b and d are both of a type of open magnetic field path. Therefore, the magnetic fields of the above-described coil "a" and of the magnetic field adjusting coil c will be generated in the vertical direction. The magnetic fields thus generated are likely to give effect on a cathode ray tube which is disposed near the coils "a" and c. Further, an axial line of each of the above-described coil "a" and of the magnetic field adjusting coil c is in parallel with the lead terminals f which are embedded into the base g. Therefore, when the linearity coil is surface-mounted on a printed-circuit board (not illustrated) and sawtooth wave electric current is charged to the coil "a", the magnetic core b is subject to extension and contraction in the vertical direction, thereby giving rise to magnetostriction vibrations to the magnetic core b. These vibrations are transmitted to the printed-circuit board to thereby generate beat notes through resonance. Further, these vibrations also cause vibrations of other neighboring component parts which are surface-mounted on the printed-circuit board, with the result that their reliability is impaired.

In view of the above-described problems with the conventional linearity coil, the present invention has an object of providing a variable linearity coil in which the magnetostriction vibrations of the magnetic core to be transmitted to the printed-circuit board on which the variable linearity coil is surface-mounted can be reduced to the smallest extent possible and in which the occurrence of beat notes due to resonance is prevented to the best extent possible, whereby the reliability of other neighboring component parts which are surface-mounted on the printed-circuit board is improved.

SUMMARY OF THE INVENTION

In order to attain the above and other objects, the present invention is a variable linearity coil comprising: a coil which is wound around a magnetic core; a permanent magnet for charging a bias magnetic field to the magnetic core; and a magnetic field adjusting coil for adjusting the bias magnetic field; wherein the coil and the magnetic field adjusting coil are respectively disposed horizontally such that an axial line of each of the coils lies perpendicular to lead terminals to which terminal ends of each of the coils are connected.

Preferably, the coil and the magnetic field adjusting coil are placed one on top of the other in a vertical direction. The coil and the magnetic field adjusting coil may also be placed side by side with each other in a horizontal direction.

Preferably, the coil, the magnetic field adjusting coil, and the permanent magnet are contained in a casing and the terminal ends of each of the coil and the magnetic field adjusting coil are connected to lead terminals which are embedded into the casing. Still furthermore, the coil, the magnetic field adjusting coil, and the permanent magnet are contained in a casing and the terminal ends of each of the coil and the magnetic field adjusting coil are connected to lead terminals which are embedded into the casing. The casing is preferably filled with an electrically insulating material such as a soft resin.

Since the coils are disposed horizontally so that the axial lines thereof become perpendicular to the lead terminals to which the terminal ends of the coils are connected, the magnetostriction vibrations of the magnetic cores around which the coil is wound are prevented, to the maximum extent possible, from vibrating the printed-circuit board on which the linearity coil is mounted.

By placing the coil and the magnetic field adjusting coil side by side with each other in the horizontal direction, the linearity coil can be lowered in height and, consequently, there is smaller effect on a cathode ray tube.

By connecting the terminal ends of the coil and of the magnetic field adjusting coil to lead terminals which are embedded into the base, the magnetostriction vibrations of the magnetic core are not directly transmitted to the lead terminals. As a result, the vibrations of the printed-circuit board can still further be reduced. Furthermore, by filling the casing with a soft electrically insulating material such as a resin or the like, the electrically insulating properties can further be improved, with the result that the vibrations of the printed-circuit board become smaller.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Preferred embodiments of the present invention will now be explained with reference to the accompanying drawings.

Figure 1A:
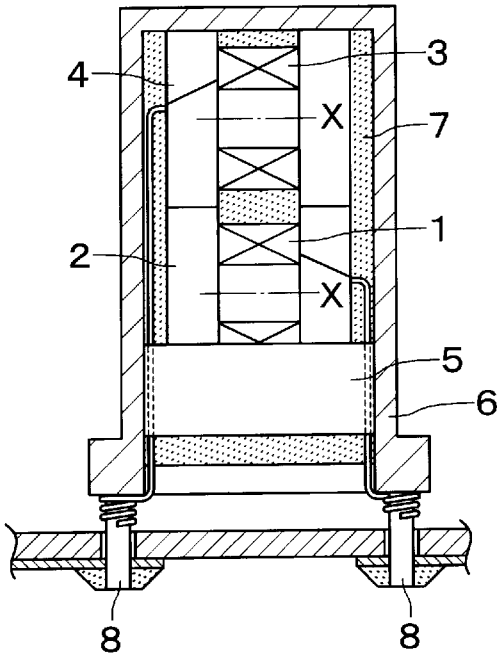
FIG. 1A is a front view, partly shown in section, of a first embodiment of a variable linearity coil according to the present invention
Figure 1B:
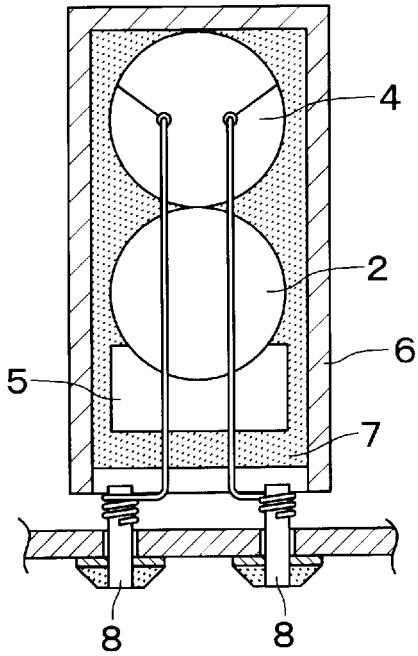
FIG. 1B is a side view, partly shown in section, thereof.

FIG. 1 shows a first example of a variable linearity coil according to the present invention. In the figure, reference numeral 1 denotes a coil which is wound around a drum-shaped core 2 made of ferrite and in which horizontal deflection current of a cathode ray tube flows. Reference numeral 3 denotes a magnetic field adjusting coil which is wound around a drum-shaped core made of ferrite and which adjusts a bias magnetic field. Reference numeral 5 denotes a permanent magnet in the shape of a rectangular parallelepiped. This permanent magnet 5 has formed on an upper surface thereof an arcuate dent so as to secure a close contact with the peripheral surfaces of flanges of the drum-shaped core 2.

The above-described coil 1 and the magnetic field adjusting coil 3 are respectively disposed horizontally and are placed on the permanent magnet 5 in a manner vertically stacked (or laid) together. The sub-assembly thus obtained is contained in a casing 6 made of a resin or the like. The clearance or the space inside the casing 6 is filled with a soft insulating material 7 such as silicone resin or the like (with a Shore hardness of, e.g., A7) which absorbs the magnetostriction vibrations of the drum-shaped core 2. On an open end portion of the casing 6 there are embedded lead terminals 8 in a direction perpendicular to the axial line "X" of each of the coil 1 and the magnetic field adjusting coil 3. Both terminal ends of the coil 1 and the magnetic field adjusting coil 3, respectively, are tied to the base portions of the lead terminals 8 and are soldered together (not illustrated).

In this linearity coil the above-described coil 1 is disposed horizontally so that the axial line "X" thereof perpendicularly crosses (i.e., crosses at right angles) the lead terminals 8. Therefore, when it is surfacemounted on a printed-circuit board (not illustrated), the magnetostriction vibrations of the drum-shaped core 2 is hardly transmitted to the printed-circuit board. Further, since the magnetic field of the coil 1 is horizontal in direction, not in the vertical direction, little or no effect will be given to a cathode ray tube which is disposed in close proximity to the coil 1. Still furthermore, since the permanent magnet 5 is disposed to bridge both the flanges of the drum-shaped core 4, there is a smaller leak of the magnetic field.

Alternatively, it is possible to dispose the permanent magnet 5 on an uppermost position and to dispose the coil 1 and the magnetic field adjusting coil 3 under the permanent magnet 5 such that the coil 1 comes directly under the permanent magnet 5 and the magnetic field adjusting coil 3 thereunder. The terminal ends of the coil 1 and of the magnetic field adjusting coil 3 may be directly tied to the lead terminals 8 or, they may be tied to lead wires embedded in the cores 2, 4 so that these lead wires are then tied to the lead terminals 8.

Figure 7:
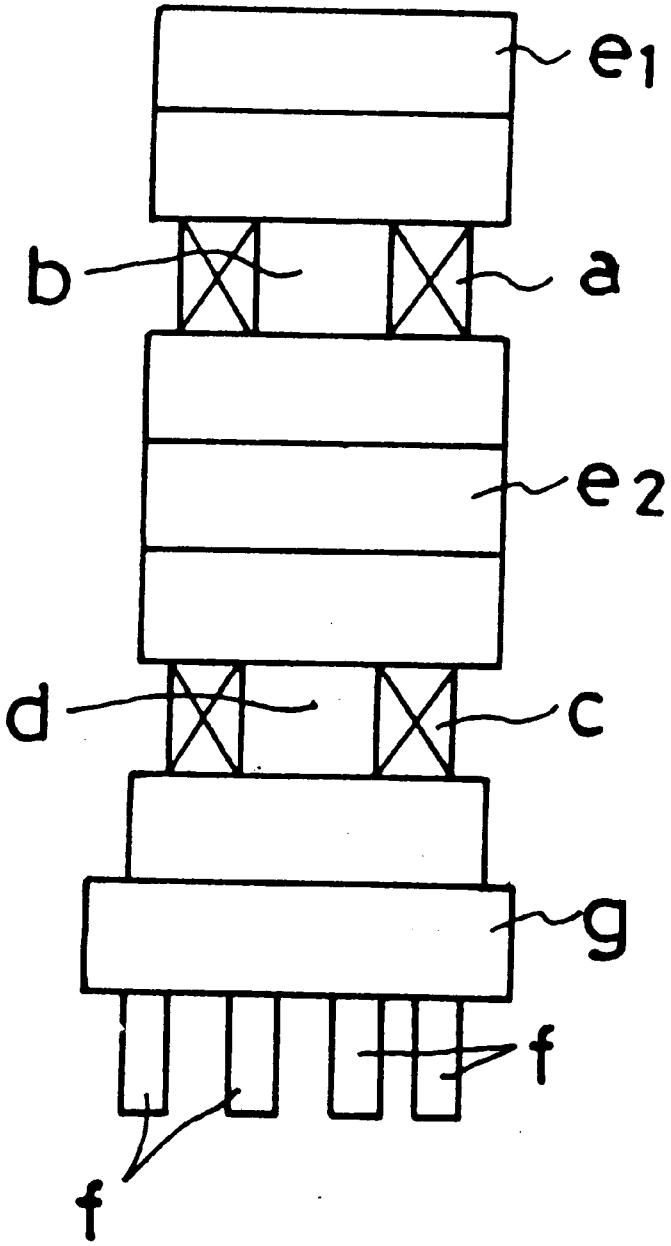
PRIOR ART FIG. 7
FIG. 7 is a front view, partly shown in section, of a conventional variable linearity coil.

The above-described linearity coil was disposed on the printed-circuit board and the lead terminals 8 was fixed to the wiring portion by means of soldering. A sawtooth wave electric current of 12A with a peak value of $I_{pp}$ at a frequency of 64 kHz is caused to flow through the coil 1. The vibration level of the printed-circuit board was measured with a vibration sensor which is attached thereon. The output of the vibration sensor was amplified by an amplifier, and a voltage value was measured by a level meter. The vibration level confirmed by this voltage value was found to be 0.05 mV, which was about one-tenth of 0.5 mV which was the value obtained in the conventional linearity coil shown in FIG. 7.

Figure 2A:
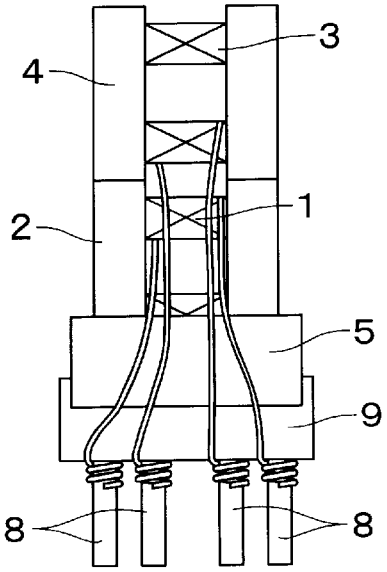
FIG. 2A is a front view, partly shown in section, of a second embodiment of a variable linearity coil according to the present invention
Figure 2B:
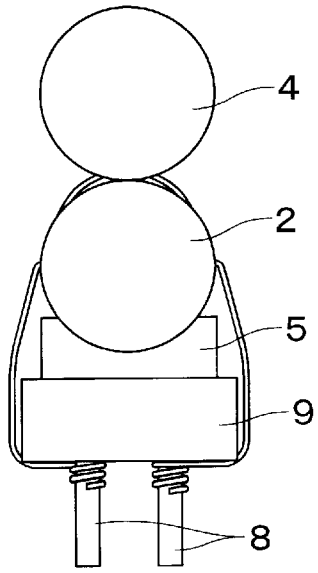
FIG. 2B is a side view thereof.

FIG. 2 shows a second example of the variable linearity coil of the present invention.

In this example, the shape and arrangement of the coil 1 which was wound around the drum-shaped core 2, the magnetic field adjusting coil 3, and the permanent magnet 5 are the same as those shown in FIG. 1. However, they are placed on, and fixed to, a base 9. The coil terminals 1 and the magnetic field adjusting coil 3 are tied to the lead terminals 8 which are embedded into the base 9, and are further soldered. These lead terminals 8 are embedded perpendicular to (or in a direction which crosses at right angles) the axes of the coil 1 and the magnetic field adjusting coil 3.

In this variable linearity coil, since the coil 1 is also disposed horizontally, the magnetostriction vibrations of the drum-shaped core 2 are hardly transmitted to the printed-circuit board. The vibrations measured in terms of voltage in the same method as in the above-described example was found to be 0.07 mV.

The above-described magnetic field adjusting coil 3 may be made by an air-core coil which is wound around a bobbin made of a resin, or an air-core coil which is coated with a resin by means of dip coating or the like in order to prevent the coil from stricken out of shape. As another modification, the following arrangement may also be employed. Namely, an electrically insulating material such as a resin, ceramic or the like of a predetermined thickness is interposed between the drum-shaped core 2 and the drum-shaped core 4. In this manner, the amount of magnetic bias to be charged to the drum-shaped core 2 is adjusted by the magnetic field adjusting coil 3.

As another modified example, the linearity coil shown in FIG. 2 may also be contained inside a casing as shown in FIG. 1 and the casing is filled with an electrically insulating material such as a resin or the like. Or else, the linearity coil may be coated with a resin by means of dip coating.

Figure 3A:
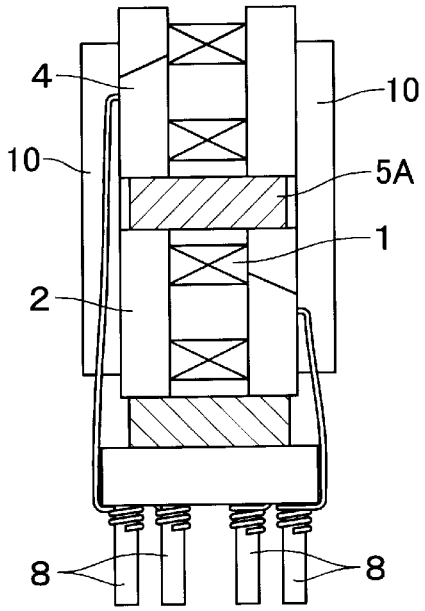
FIG. 3A is a front view, partly shown in section, of a third embodiment of a variable linearity coil according to the present invention
Figure 3B:
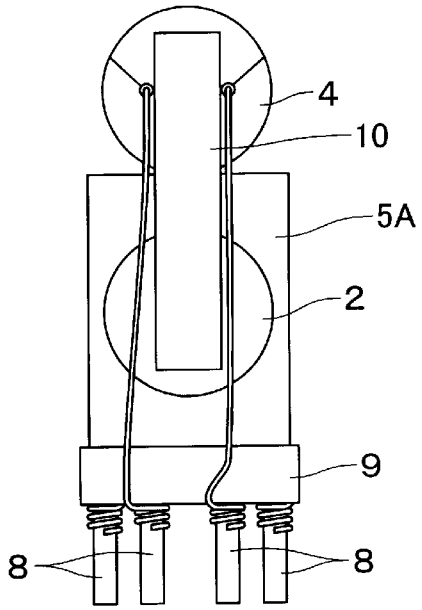
FIG. 3B is a side view thereof.

FIG. 3 shows a third example of the linearity coil of the present invention.

In this example, the drum-shaped core 2 around which the coil 1 is wound is enclosed by a sleeve-shaped permanent magnet 5A which is substantially the same in inner diameter as the flanges of the drum-shaped core 2 and which is formed in its external shape into a rectangular parallelepiped. The drum-shaped core 4 is disposed on top of the permanent magnet 5A. One and the other of the flanges of the drum-shaped core 2 and one and the other of the flanges of the drum-shaped core 4 are respectively coupled together by means of bar-shaped magnetic materials 10, 10 which are made of ferrites. Like in the example shown in FIG. 2, the above-described sub-assembly is placed on, and fixed to, the base 9 into which the lead terminals 8 are embedded.

In the drum-shaped core 2, a closed magnetic path with a smaller magnetic resistance than that shown in FIGS. 1 and 2 is formed by the sleeve-shaped permanent magnet 5A. Therefore, there will be no leak in magnetic flux in the coil 1, and the inductance L of the coil 1 can be largely varied. Furthermore, since the drum-shaped core 2 and the drum-shaped core 4 are connected together by means of the magnetic materials 10, 10, a magnetic path is formed between both the cores 2, 4, with the result that the range in which the inductance of the coil 1 can be varied is made larger.

The vibration of the printed-circuit board measured in terms of voltage in the same way as in the above-described examples was found to be 0.10 mV.

As another modified example, instead of the above-described sleeve-shaped permanent magnet 5, two permanent magnets formed substantially in the configuration of "C" embedded lead terminals into a lower portion thereof, there are horizontally disposed a coil 1 which has wound around a drum-shaped core 2 and a magnetic field adjusting coil 3 which is wound around a drum-shaped core 4, both coils 1 and 4 being disposed in parallel with each other. On both ends of the drum-shaped core 2, permanent magnets 5B, 5B are disposed so as to bridge a pair of flanges of the drum-shaped core 2.

The linearity coil of this example can be made smaller in height and, therefore, an effect on a cathode ray tube can be eliminated. The vibrations of the printed-circuit board measured in terms of voltage in the same way as in the above-described examples were found to be 0.07 mV.

This linearity coil may also employ the following construction. Namely, it is contained inside a casing, the casing is filled with an electrically insulating material such as a resin or the like, and the lead terminals 8 are extended out of the casing. Further, the drum-shaped core 2 and the drum-shaped core 4 are connected together by means of a magnetic material such as ferrite or the like to thereby enhance the magnetic coupling between the coil 1 and the magnetic field adjusting coil 3.

Figure 5A:
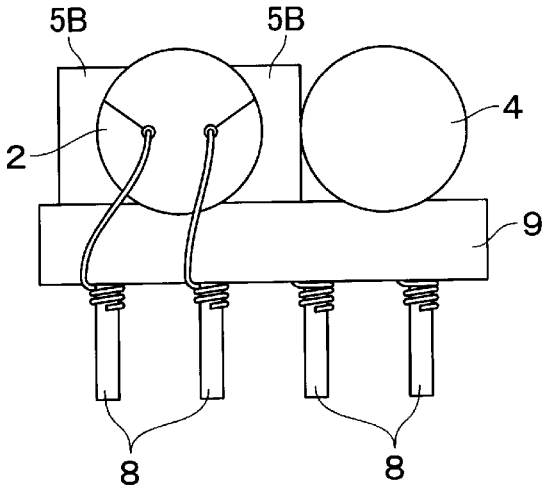
FIG. 5A is a side view of a fifth embodiment of a variable linearity coil according to the present invention and FIG. 5B is a front view, thereof.
Figure 5B:
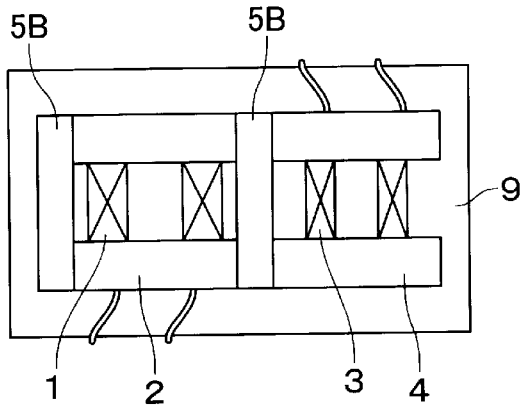

In the example shown in FIG. 5, the base 9 has embedded therein lead terminals 8 in a lower potion thereof. The following construction may also be employed. may be employed.

The variable linearity coil of this example may also be contained inside a casing, and the casing is filled with an electrically insulating material such as a resin or the like. Or else, the linearity coil may be coated by means of dip coating with an electrically insulating material such as a resin.

Figure 4A:
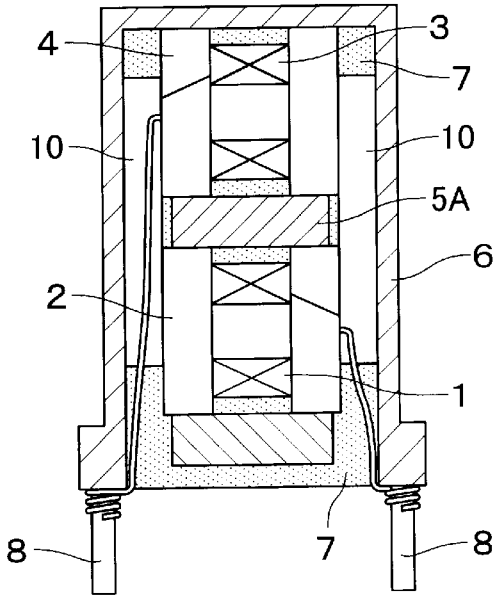
FIG. 4A is a front view, partly shown in section, of a fourth embodiment of a variable linearity coil according to the present invention
Figure 4B:
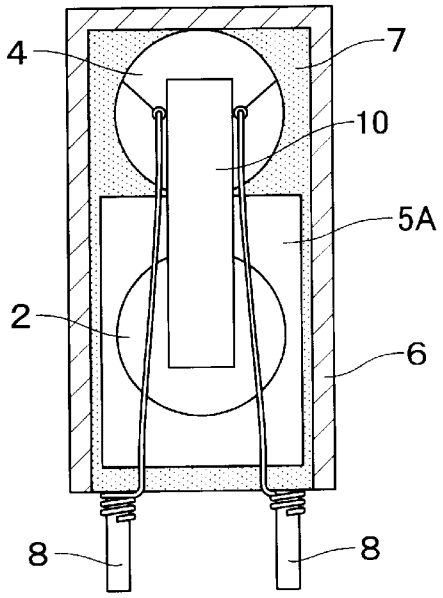
FIG. 4B is a side view, partly shown in section, thereof.

FIG. 4 shows a fourth example of the variable linearity coil of the present invention.

While the variable linearity coil shown in FIG. 3 uses the base 9 and lead terminals 8 which are embedded thereinto, this fourth example does not employ a base 9. Instead, like in the example shown in FIG. 1, there is used a casing 6 with lead terminals 8 which are embedded into an open end of the casing 6. Inside the casing 6 there are contained a coil 1 which is wound around a drum-shaped core 2, a magnetic field adjusting coil 3 which is wound around a drum-shaped core 4, and a sleeve-shaped permanent magnet 5A. Like the electrically insulating material 7 shown in FIG. 1, the casing 6 is filled therein with a soft electrically insulating material 7.

The vibrations of the printed-circuit board measured in terms of voltage in the same way as in the above-described examples were found to be 0.05 mV.

FIG. 5 shows a fifth example of a variable linearity coil of the present invention.

In this example, on top of a base 9 which has Namely, a linearity coil having the same construction as that shown in FIG. 5 except that the base 9 is not employed is contained inside a casing which has lead terminals embedded in an open end thereof. The casing is then filled with an electrically insulating material such as a resin or the like.

Figure 6:
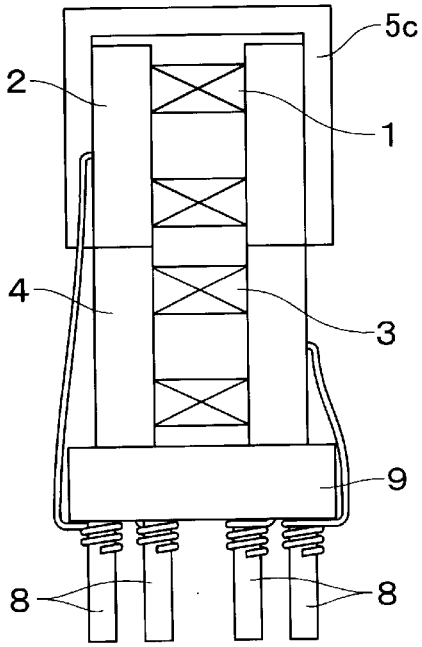
FIG. 6 is a front view, partly shown in section, of a sixth embodiment of a variable linearity coil according to the present invention.

FIG. 6 shows a sixth example of the variable linearity coil of the present invention.

In the variable linearity coil shown in FIG. 2, the permanent magnet 5 is disposed on the base 9, and the drum-shaped core 2 and the drum-shaped core 4 are sequentially placed one on top of the other in the vertical direction. In this sixth example, on the other hand, the following arrangement is employed contrary to that shown in FIG. 2. Namely, the drum-shaped core 2 is placed on top of the drum-shaped core 4, and this sub-assembly is fixedly mounted on the base 9. A permanent magnet 5C which is substantially U-shaped so as to contact outer surfaces of the two flanges of the drum-shaped core 2 is fixedly disposed. In this example, since the permanent magnet 5C contacts a wide outer surfaces of the flanges of the drum-shaped core 2, there will be a still smaller leak in the magnetic flux of the coil 1.

The vibrations of the printed-circuit board measured in terms of voltage in the same way as in the above-described examples were found to be 0.09 mV.

The example shown in FIG. 6 may also be contained in a casing and the casing is then filled with an electrically insulating material such as a resin or the like. Further, the base 9 shown in FIG. 6 may be eliminated so that the remaining portion is contained in a casing which has lead terminals embedded therein. The casing is then filled with a soft electrically insulating material like the electrically insulating material 7 shown in FIG. 7.

As explained hereinabove, according to the present invention, when the variable linearity coil is surface-mounted on the printed-circuit board, the magnetostriction vibrations of the magnetic core transmitted to the printed-circuit board can be reduced to the best extent possible. As a result, the beat notes through resonance can be minimized to the best extent possible. The reliability of other nearby component parts which are surface-mounted on the printed-circuit board can also be improved.

It is readily apparent that the above-described variable linearity coil meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A combination, comprising:

a combination coil comprising:

a coil which is wound around a magnetic core, the coil having a central axis;

a permanent magnet disposed so as to reduce a leak in a magnetic flux generated by said coil; and a magnetic field adjusting coil for adjusting the magnetic field, the magnetic field adjusting coil having a central axis;

wherein said coil and said magnetic field adjusting coil are respectively disposed such that the central axis of said coil and the central axis of said magnetic field adjusting coil are spaced apart and the central axis of said coil and the central axis of said magnetic field adjusting coil are configured to lie substantially parallel to a circuit board, and wherein said combination coil is mounted on said circuit board via surface mounting lead terminals to said circuit board.

2. A combination according to claim 1, wherein said coil and said magnetic field adjusting coil are placed one on top of the other in a direction substantially perpendicular to the central axis of said coil and the central axis of said magnetic field adjusting coil lie substantially parallel to said circuit board.

3. A combination according to claim 1 wherein said coil and said magnetic field adjusting coil are side by side with each other in a direction substantially perpendicular to the central axis of said coil and the central axis of said magnetic field adjusting coil and lie substantially perpendicular to said circuit board.

4. A combination according to claim 1, wherein said coil, said magnetic field adjusting coil, and said permanent magnet are contained in a casing and wherein the terminal ends of each of said coil and of said magnetic field adjusting coil are connected to lead terminals which are embedded into said casing.

5. A combination according to claim 2, wherein said coil, said magnetic field adjusting coil, and said permanent magnet are contained in a casing and wherein the terminal ends of each of said coil and of said magnetic field adjusting coil are connected to lead terminals which are embedded into said casing.

6. A combination according to claim 3, wherein said coil, said magnetic field adjusting coil, and said permanent magnet are contained in a casing and wherein the terminal ends of each of said coil and of said magnetic field adjusting coil are connected to lead terminals which are embedded into said casing.

7. A combination according to claim 1, wherein said coil, said magnetic field adjusting coil, and said permanent magnet are placed on a base and wherein terminal ends of said coil and of said magnetic field adjusting coil are connected to lead terminals which are embedded into said base.

8. A combination according to claim 2, wherein said coil, said magnetic field adjusting coil, and said permanent magnet are placed on a base and wherein terminal ends of said coil and of said magnetic field adjusting coil are connected to lead terminals which are embedded into said base.

9. A combination according to claim 3, wherein said coil, said magnetic field adjusting coil, and said permanent magnet are placed on a base and wherein terminal ends of said coil and of said magnetic field adjusting coil are connected to lead terminals which are embedded into said base.

10. A variable linearity coil according to claim 4, wherein said casing is filled with an electrically insulating soft resin which allows movement of said core within said casing.

11. A variable linearity coil according to claim 5, wherein said casing is filled with an electrically insulating soft resin which allows movement of said core within said casing.

12. A combination according to claim 6, wherein said casing is filled with an electrically insulating soft resin which allows movement of said core within said casing.

13. A combination comprising:

a first magnetic core;

a primary coil wound around the first magnetic core, the primary coil having a primary coil axis extending through the center of the primary coil;

a second magnetic core;

a magnetic field adjusting coil wound around the second magnetic core, the adjusting coil having an adjusting coil axis extending through the center of the adjusting coil; and a permanent magnet, wherein the permanent magnet is proximate the primary coil and the permanent magnet forms a magnetic circuit with the first magnetic core, whereby the magnetic field leakage from the primary coil is reduced, and wherein the adjusting coil is proximate the primary coil, the adjusting coil axis is substantially parallel to the primary coil axis, and the adjusting coil axis is spaced apart from the primary coil axis.

14. The combination of claim 13, wherein the permanent magnet has a central axis and the central axis is substantially parallel to and substantially in the same plane as the primary coil axis and the adjusting coil axis.

* * * * *

UNITED STATES PATENT AND TRADEMARK OFFICE

CERTIFICATE OF CORRECTION

PATENT NO. : 6,229,424 B1
DATED : May 8, 2001
INVENTOR(S) : Takashi Tajima et al.

It is certified that error appears in the above-identified patent and that said Letters Patent is hereby corrected as shown below:

Claim 3,
Line 5, delete "and".

Signed and Sealed this

Eighth Day of January, 2002

*Attest:*

*Attesting Officer*

JAMES E. ROGAN
*Director of the United States Patent and Trademark Office*